US008755697B2

(12) United States Patent
Arai

(10) Patent No.: US 8,755,697 B2
(45) Date of Patent: Jun. 17, 2014

(54) IMAGE FORMING APPARATUS

(71) Applicant: Hiroyuki Arai, Tokyo (JP)

(72) Inventor: Hiroyuki Arai, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 95 days.

(21) Appl. No.: 13/651,998

(22) Filed: Oct. 15, 2012

(65) Prior Publication Data

US 2013/0094867 A1 Apr. 18, 2013

(30) Foreign Application Priority Data

Oct. 18, 2011 (JP) ..... 2011-228779

(51) Int. Cl.
*G03G 15/00* (2006.01)

(52) U.S. Cl.
USPC ..... 399/21; 399/388; 399/391; 271/9.01

(58) Field of Classification Search
USPC ..... 399/21, 22, 23, 45, 388, 391, 401, 373, 399/124
See application file for complete search history.

(56) References Cited

FOREIGN PATENT DOCUMENTS

| | | |
|---|---|---|
| JP | 09-077318 | 3/1997 |
| JP | 10-291688 | 11/1998 |
| JP | 2002-268299 | 9/2002 |

OTHER PUBLICATIONS

Japanese Office Action, Notification of Reasons for Refusal, Patent Application No. 2011-228779, drafting date: Oct. 1, 2013 (2 pages).
English translation of Japanese Office Action, Notification of Reasons for Refusal, Patent Application No. 2011-228779, drafting date: Oct. 1, 2013 (4 pages).

*Primary Examiner* — Matthew G Marini
(74) *Attorney, Agent, or Firm* — Lucas & Mercanti,LLP

(57) ABSTRACT

An image forming apparatus includes a carrying unit, a resistance unit, a jam detection unit, a paper detection unit and a control unit. Responding to the jam detection unit detecting that a jam occurring location is outside the resistance unit, the control unit sets a part of the carrying unit, the part including at least the resistance unit, as an accumulation unit where a remaining sheet is accumulated, in accordance with a size of the remaining sheet. The remaining sheet is detected by a paper detection unit when the jam occurs. The control unit releases, among a resistance roller pair and carrying roller pairs of the carrying unit, the rollers of a pair located in the accumulation unit from pressing against each other, and makes the carrying unit carry the remaining sheet to the accumulation unit.

8 Claims, 8 Drawing Sheets

FIG.3

T1

| PAPER SIZE ≤ 11 in. | | BASIS WEIGHT [g/m²] | | | | | | | |
|---|---|---|---|---|---|---|---|---|---|
| | | 64−74 | 75−80 | 81−105 | 106−135 | 136−162 | 163−220 | 221−256 | 257−300 |
| PAPER TYPE | PLAIN PAPER | 10 | 10 | 8 | 8 | 5 | 5 | 3 | 1 |
| | HIGH-QUALITY PAPER | 10 | 10 | 7 | 7 | 5 | 5 | 3 | 1 |
| | COATED PAPER | 8 | 8 | 5 | 5 | 3 | 3 | 2 | 1 |

FIG.4

T2

| PAPER SIZE > 11 in. | | BASIS WEIGHT [g/m²] | | | | | | | |
|---|---|---|---|---|---|---|---|---|---|
| | | 64–74 | 75–80 | 81–105 | 106–135 | 136–162 | 163–220 | 221–256 | 257–300 |
| PAPER TYPE | PLAIN PAPER | 5 | 5 | 4 | 4 | 3 | 2 | 1 | 1 |
| | HIGH-QUALITY PAPER | 5 | 5 | 3 | 3 | 3 | 1 | 1 | 1 |
| | COATED PAPER | 5 | 4 | 3 | 3 | 2 | 1 | 1 | 1 |

IMAGE FORMING APPARATUS

BACKGROUND OF THE INVENTION

1. Field of the Invention

The present invention relates to an image forming apparatus.

2. Description of the Related Art

Conventionally, there is known an image forming apparatus, such as a copier, including a paper feeding tray unit, which is referred to as PFU (paper Feeder Unit), having a plurality of paper feeding trays, so that a large number of sheets of paper are able to be fed thereinto. There is also known an image forming apparatus having a mechanism to perform printing processing on both sides of paper (double-sided printing) in addition to printing processing on one side of paper (single-sided printing).

If a paper jam occurs in these image forming apparatuses, the image forming apparatuses immediately stop carrying sheets of paper. In order to restart the image forming apparatuses, it is necessary to remove the jammed sheet jammed therein.

However, for example, in a case where a large number of sheets of paper are carried in an image forming apparatus during processing, such as a case where an image forming apparatus having a PFU performs double-sided printing, it is necessary to remove not only a jammed sheet but also sheets being carried (remaining sheets) in the image forming apparatus when a jam occurs. Accordingly, there is a plurality of locations from which the sheets need to be removed, so that it takes time and trouble to recover the image forming apparatus.

Then, for example, Japanese Patent Application Laid-Open Publication No. 2002-268299 proposes a technology to, when a jam occurs, carry remaining sheets to a reverse paper path which reverses sheets of paper, the remaining sheets being in locations which seem no problem for the remaining sheets therein to continue to be carried, and to remove the remaining sheets from the reverse paper path in a lump.

However, because the technology proposed by the Japanese Patent Application Laid-Open Publication No. 2002-268299 is a technology to accumulate remaining sheets on a reverse paper path, it is difficult to remove the accumulated remaining sheets.

In addition, the technology proposed by the Japanese Patent Application Laid-Open Publication No. 2002-268299 does not take the sizes of the remaining sheets into account, and hence, regardless of the sizes of the remaining sheets, the accumulation is performed in the same manner. Consequently, there is a possibility that a secondary jam is caused by the accumulation, or the apparatus is damaged thereby and the like.

SUMMARY OF THE INVENTION

The present invention is made in view of the above-described problems of the conventional technology. Objects of the present invention include providing an image forming apparatus which makes it easier to remove remaining sheets existing in the image forming apparatus when a jam occurs, without damaging the image forming apparatus itself.

In order to achieve at least one of the objects described above, according to an aspect of the present invention, there is provided an image forming apparatus including: a paper feeding unit which sends out a sheet of paper from a paper feeding tray where the sheet is housed; a transfer unit which transfers a toner image formed on an image holder to the sheet sent out by the paper feeding unit; a carrying unit including a first paper path provided with a plurality of carrying roller pairs each of which is a pair of rollers capable of pressing against each other and being separated from each other, the carrying unit which carries the sheet sent out by the paper feeding unit to the transfer unit with the first paper path; a resistance unit disposed in the carrying unit, and including a resistance roller pair which is a pair of rollers capable of pressing against each other and being separated from each other, the resistance unit which carries the sheet to the transfer unit after stopping the sheet on an upstream side of the transfer unit; a jam detection unit which detects a jam occurring location where a jam occurs; a paper detection unit which detects a sheet location of the sheet being carried; and a control unit which, in response to the jam detection unit detecting that the jam occurring location is outside the resistance unit, (i) sets, in accordance with a size of a remaining sheet which is being carried and is detected by the paper detection unit when the jam occurs, a part of the carrying unit as an accumulation unit where the remaining sheet is accumulated, the part including at least the resistance unit, (ii) releases, among the resistance roller pair and the carrying roller pairs, the rollers of a pair located in the accumulation unit from pressing against each other, and (iii) makes the carrying unit carry the remaining sheet to the accumulation unit.

BRIEF DESCRIPTION OF THE DRAWING

The present invention will be fully understood by the following detailed description and the accompanying drawings, which are not intended to limit the present invention, wherein:

FIG. 3 shows an example of a setting table;

FIG. 4 shows another example of the setting table;

DETAILED DESCRIPTION OF THE PREFERRED EMBODIMENT

In the following, an image forming apparatus in accordance with an embodiment of the present invention is described in detail, referring to the accompanying drawings. However, the present invention is not limited to the embodiment the drawings.

Figure 1:
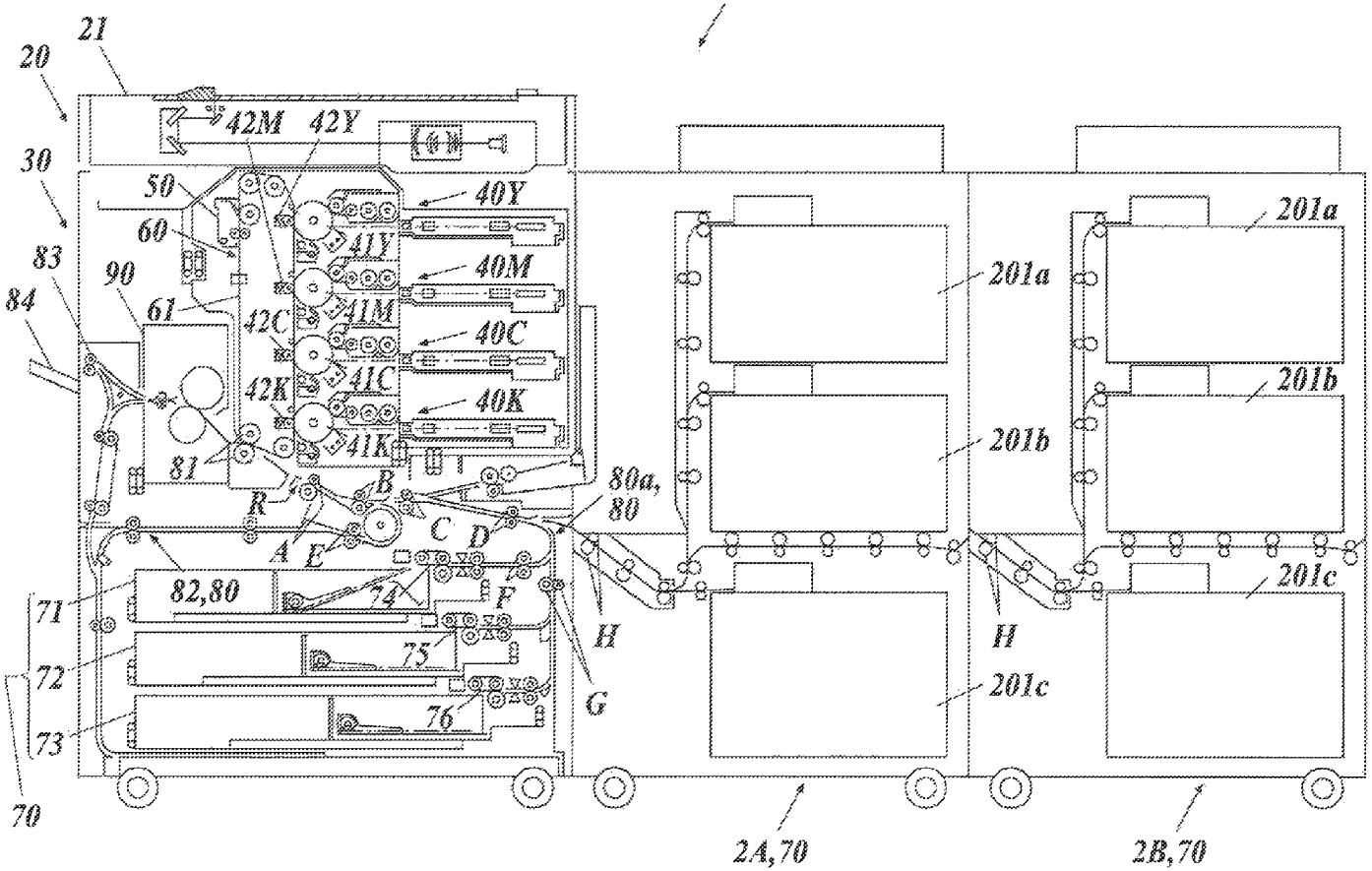
FIG. 1 is a cross-sectional view schematically showing a configuration of an image forming apparatus in accordance with an embodiment of the present invention.

FIG. 1 is a cross-sectional view schematically showing a configuration of an image forming apparatus 1 in accordance with an embodiment of the present invention.

The image forming apparatus 1 is a digital multifunction printer (MFP) having a copier function, a printer function, and the like. The copier function is a function to read images from reading target documents NP ("document" hereinafter) and form the read images on paper such as flat paper as processing target paper. The printer function is a function to receive image data from a personal computer or the like, form images on paper on the basis of the received image data, and output the images. The image forming apparatus 1 has an openable/closable front door (not shown) on the front surface.

As shown in FIG. 1, the image forming apparatus 1 includes an image reading unit 20 and a printing unit 30.

The image reading unit 20 includes a reading unit 21. The reading unit 21 is constituted of a scanner which includes a light source, a lens, a contact glass, and an image sensor 21*a*. The reading unit 21 reads images on documents WP by forming the images with reflected light of light with which the documents WP are irradiated, and performing photoelectric conversion. Then, the reading unit 21 outputs the images to the printing unit 30. The images include not only image data such as figures and pictures but also text data such as letters and symbols.

An automatic document feeding unit such as an ADF (Auto Document. Feeder) may be disposed over the reading unit 21.

The printing unit 30 includes an image forming unit 40, a cleaning unit 50, a transfer unit 60, a paper feeding unit 70, a carrying unit 80, and a fixing unit 90.

The image forming unit 40 includes image forming units 40Y, 40M, 40C and 40K which are able to be filled with toner of different colors to form images constituted of a maximum of four colors (yellow Y, magenta M, cyan C and black K).

For example, the image forming unit 40Y includes a photosensitive drum 41Y, a charging device disposed in the vicinity of the photosensitive drum 41Z, an exposing device, a developing device, a cleaning device, and a primary transfer roller 42Y, and forms yellow (Y) images.

More specifically, the charging device of the image forming unit 40Y charges the photosensitive drum 41Y in such a way that charge on the surface of the photosensitive drum 41Y is uniform, and the exposing device thereof irradiates the charged photosensitive drum 41Y with light corresponding to yellow (Y) image data, so as to form electrostatic latent images thereon.

The developing device thereof is filled with two-component developer which is mixture of magnetic carriers and non-magnetic toner.

The developing device develops the electrostatic latent images by attaching charged yellow (Y) toner to the surface of the photosensitive drum 41Y where the electrostatic latent images are formed, so as to form toner images. The development is performed by reversal phenomena which are application of developing bias made by overlaying an AC voltage with a DC voltage having the same polarity as that of the toner to be used.

While the photosensitive drum 41Y to which the toner is attached by the developing device rotates at a predetermined fixed speed, the toner (toner images) thereon is transferred to an intermediate transfer belt 61 described below at a primary transfer point where the primary transfer roller 42Y is disposed. After the toner is transferred to the intermediate transfer belt 61, the cleaning device removes the remaining charge, the remaining toner and the like on the surface of the photosensitive drum 41Y.

The amount of toner attached to the surface of the photosensitive drum 41Y is predetermined in such a way that images formed by the image forming unit 40Y have a predetermined density.

Similarly, each of the image forming units 40M, 40C and 40K includes a photosensitive drum 41M, 41C or 41K, a charging device disposed in the vicinity of the photosensitive drum 41M, 41C or 41K, an exposing device, a developing device, a cleaning device, and a primary transfer roller 42M, 42C or 42K. The image forming units 40M, 40C and 40K form magenta (M) images, cyan (C) images and black (K) images, respectively.

The transfer unit 60 includes the intermediate transfer belt 61 as an image holder. The intermediate transfer belt 61 is a semi-conductive endless belt placed over a plurality of rollers so as to be held thereby to rotate. The intermediate transfer belt 61 is driven to rotate by rotation of the rollers.

The intermediate transfer belt 61 is pressed against the photosensitive drums 41Y, 41M, 41C and 41K by their respective primary transfer rollers 42Y, 42M, 42C and 42K. Consequently, the yellow toner, the magenta toner, the cyan toner and the black toner attached to the surfaces of the photosensitive drums 41Y, 41M, 41C and 41K, respectively, are transferred to the intermediate transfer belt 61 at their respective primary transfer points where the primary transfer rollers 42Y, 42M, 42C and 42K are respectively disposed, and are successively transferred to paper so as to be superposed on top of each other to form a color toner image at a secondary transfer point where a secondary transfer roller pair 81, which is a pair of rollers, is disposed.

After the toner images on the intermediate transfer belt 61 are transferred to paper, the cleaning unit 50 removes the remaining toner on the intermediate transfer belt 61.

The paper feeding unit 70 includes paper feeding trays 71 to 73 and paper feeding tray units 2A and 2B each of which houses a large number of sheets of paper therein so as to perform paper feeding.

Sheets of paper classified in advance on the basis of the kind (size, paper type, basis weight, and the like) of paper are housed in the paper feeding trays 71 to 73.

The sheets of paper housed in the paper feeding tray 71 are sent out one by one from the top by paper feeding rollers 74 to a carrying roller pair D, which is a pair of rollers, via a carrying roller pair F, which is a pair of rollers.

The sheets of paper housed in each of the paper feeding trays 72 and 73 are sent out one by one from the top by paper feeding rollers 75 or 76 to the carrying roller pair D via a carrying roller pair G, which is a pair of rollers.

The paper feeding tray units 2A and 2B are referred to as PFU (Paper Feeder Unit) and each have a three-shelf configuration (the top shelf, the middle shelf and the bottom shelf), namely, paper feeding trays 201*a* to 201*c*.

Sheets of paper classified in advance on the basis of the kind (size, paper type, basis weight, and the like) of paper are housed in the paper feeding trays 201*a* to 201*c* of each of the paper feeding tray units 2A and 2B.

The paper feeding tray units 2A and 2B each send out the sheets of paper housed in each of the paper feeding trays 201*a* to 201*c* one by one from the top to the carrying roller pair D in response to control signals transmitted from a body unit 1*a* (shown in FIG. 2) of the image forming apparatus 1.

For example, the paper sent out from the paper feeding trays 201*a* to 201*c* of the paper feeding tray unit 2A is ejected from the paper feeding tray unit 2A via a carrying roller pair H, which is a pair of rollers, of the paper feeding tray unit 2A, so as to reach the carrying roller pair D. The carrying roller pair H of the paper feeding tray unit 2A is for ejecting sheets of paper from the paper feeding tray unit 2A.

Furthermore, the paper sent out from the paper feeding trays 201*a* to 201*c* of the paper feeding tray unit 2B is ejected from the paper feeding tray unit 2B via a carrying roller pair H, which is a pair of rollers, of the paper feeding tray unit 2B, and ejected from the paper feeding tray unit 2A via a paper path in the paper feeding tray unit 2A and the carrying roller pair H of the paper feeding tray unit 2A, so as to reach the carrying roller pair D. The carrying roller pair H of the paper feeding tray unit 2B is for ejecting sheets of paper from the paper feeding tray unit 2B.

Different identification numbers such as "Tray 1" to "Tray 9" are given to the paper feeding trays 71 to 73, the paper feeding trays 201*a* to 201*c* of the paper feeding tray unit 2A, and the paper feeding trays 201*a* to 201*c* of the paper feeding tray unit 2B, respectively, so that a control unit 110 (described below) recognizes these trays.

The carrying unit 80 includes a first paper path 80*a* where a resistance roller pair A, a plurality of carrying roller pairs B, C, B, F, G and H, the secondary transfer roller pair 81, and the like are disposed.

The resistance roller pair A is a pair of rollers which are on top of each other. Each of the carrying roller pairs B, C, D, F, G and H is a pair of rollers which are on top of each other. The rollers of each pair can press against each other and can be separated from each other.

The paper carried from the paper feeding trays 71 to 73 or the paper introduced from the paper feeding tray units 2A and 2B is carried to the secondary transfer roller pair 81 via the carrying roller pairs D, C and B and the resistance roller pair A in the order named.

The paper is stopped by a resistance unit R were the resistance roller pair A is disposed. Then, a tilt of the paper is corrected, and also a carrying timing for the paper is adjusted.

More specifically, the rollers of each of the carrying roller pairs B to D are separated from each other at the timing when the top of the paper reaches the resistance roller pair A, and then the tilt of the paper is corrected.

In addition, the rollers of each of the carrying roller pairs B to B are separated from each other at the timing when the paper starts to be carried to the secondary transfer roller pair 81 from the resistance roller pair A, so that a load on the bottom of the paper is removed, and the paper, which is carried from the resistance roller pair A, is stably and smoothly carried thereto along the first paper path 80*a* accordingly.

The paper carried from the resistance roller pair A is sandwiched between and pressed by the rollers of the secondary transfer roller pair 81 thereafter, and consequently the toner images transferred to the intermediate transfer belt 61 are successively transferred to the paper so as to form the color toner image thereon.

The carrying unit 80 also includes a reverse paper path (second paper path) 82 where a carrying roller pair E, which is a pair of rollers, and a paper path change board (not shown) are disposed.

In a case where double-sided printing is performed on paper, the reverse paper path 82 reverses the paper, to one side of which the toner images (the color toner image) are transferred by the intermediate transfer belt 61, and carries the paper to the first paper path 80*a*.

That is, the paper path change board switches a paper path of the paper, to one side of which the toner images (the color toner image) are transferred by the intermediate transfer belt 61, to the reverse paper path 82, so that the paper is carried to the reverse paper path 82. The paper is made to switchback, and carried to the secondary transfer roller pair 81 again via the carrying roller pair E, the carrying roller pair B, and the resistance roller pair A in the order named.

The fixing unit 90 includes a heating roller which has a heat source, and a pressure roller which contacts the heating roller by pressing the heating roller so as to form a nip part. The fixing unit 90 fixes the toner images (the color toner image), which are transferred to paper, by heat. The paper on which the color toner image is fixed is sandwiched between and held by paper ejection rollers 83, so as to be outputted onto a paper ejection tray 84.

The paper feeding unit 70, the carrying unit 80 and the fixing unit 90 are provided with paper detection sensors (paper detection unit) 401 (shown in FIG. 2) to detect sheet locations of sheets of paper being carried.

As the paper detection sensors 401, for example, photo sensors can be used. A photo sensor includes a light emitting unit and a light receiving unit, and detects that paper passes through by detecting, with the light receiving unit, reflected light of light emitted from the light emitting unit, the reflected light being reflected by images on the paper.

The paper detection sensors 401 are disposed, for example, on the downstream side of the resistance roller pair A and of each of the carrying roller pairs B to H in a paper conveyance direction. Then, the paper detection sensors 401 detect paper when the paper passes through the resistance roller pair A and the carrying roller pairs B to H, respectively, and transmit paper detection signals to the control unit 110 (described below). The paper detection signals contain information on the size of the paper.

The paper feeding unit 70, the carrying unit 80 and the fixing unit 90 are also provided with jam detection sensors (jam detection unit) 402 (shown in FIG. 2) to detect locations where jams occurs (jam occurring locations).

Each jam detection sensor 402 is constituted of, for example, two photo sensors disposed along a paper path with a predetermined distance in between, and detects where a jam occurs from a period of time between the time when paper is detected with the photo sensor on the upstream side and the time when the paper is detected with the photo sensor on the downstream side in the paper conveyance direction. The photo sensor on the upstream side is also used as the paper detection sensor 401.

The jam detection sensors 402 detect malfunction in carrying paper (jams) caused by the paper which passes through, for example, the resistance roller pair A and the carrying roller pairs B to H, and transmit jam detection signals to the control unit 110 (described below). The jam detection signals contain information on jam occurring locations.

Figure 2:
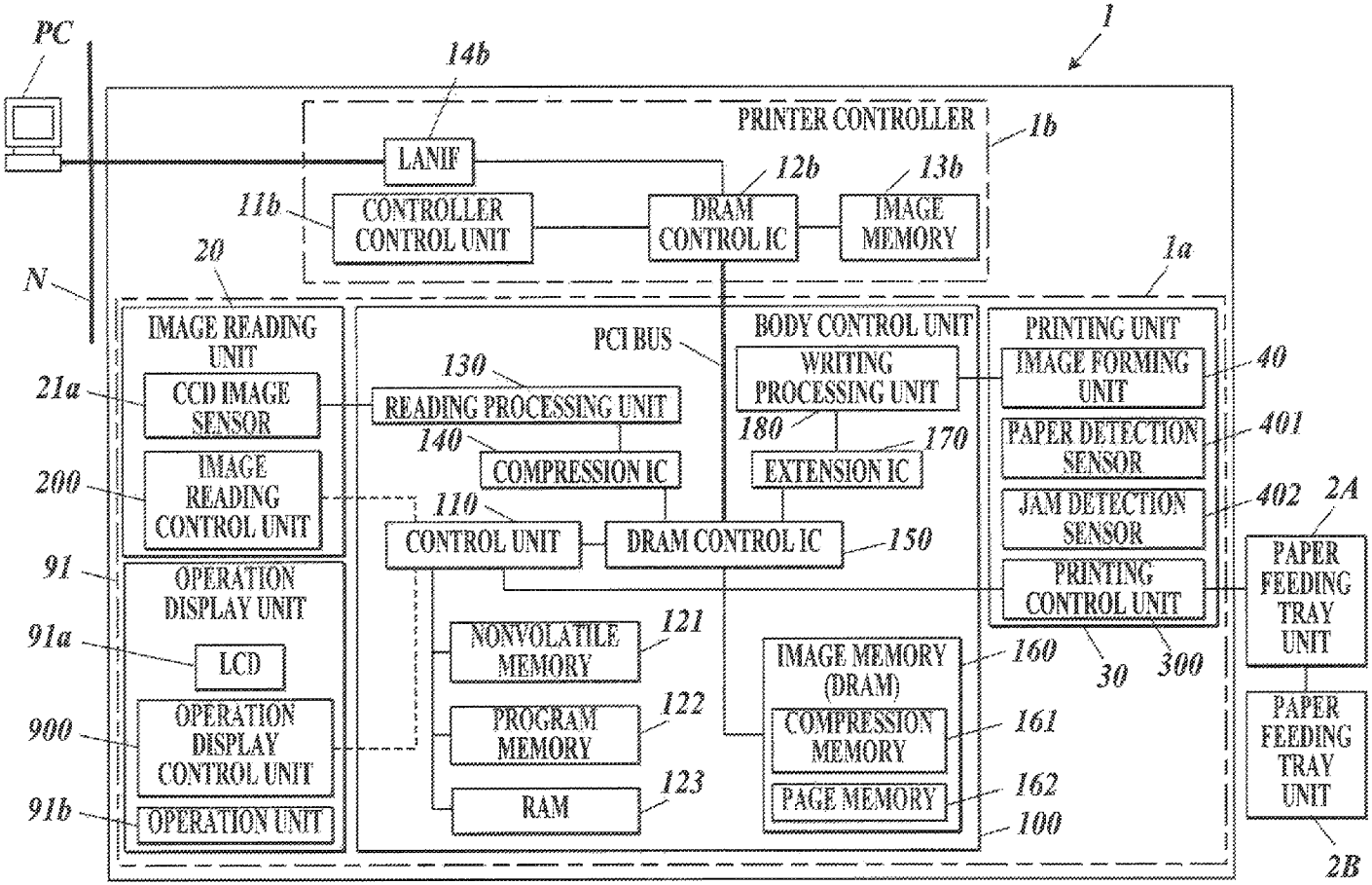
FIG. 2 is a block diagram showing a control configuration of the image forming apparatus shown in FIG. 1.

FIG. 2 is a block diagram showing a control configuration of the image forming apparatus 1.

As shown in FIG. 2, the image forming apparatus 1 includes the body unit 1*a* and a printer controller 1*b*. The image forming apparatus 1 is connected with an external device PC on a network N via an LANIF (Local Area Network InterFace) 14*b* of the printer controller 1*b* so as to be communicable with the external device PC.

In a case where the image forming apparatus 1 is used as a network printer, the printer controller 1*b* manages and controls print jobs inputted to the image forming apparatus 1 from the external device PC, which is connected to the network N. The printer controller 1*b* has a function to receive data to be printed from the external device PC, and delivers the data as print, jobs to the body unit 1*a* in accordance with operation statuses of the image forming apparatus 1.

The printer controller 1*b* includes a controller control unit 11*b*, a DRAM (Dynamic Random Access Memory) control IC 12*b*, an image memory 13*b* and the LANIF 14*b*.

The controller control unit 11*b* controls operations of the components of the printer controller 1*b* overall, and realizes a function to deliver data inputted from the external device PC as jobs (including print jobs) to the body unit 1*a* via the LANIF 14*b* in accordance with the operation statuses of the image forming apparatus 1.

The DRAM control IC 12*b* controls storage of data received by the LANIF 14*b* into the image memory 13*b* and reading of the data from the image memory 13*b*. Furthermore, the DRAM control IC 12*b* is connected with a DRAM control IC 150 of a body control unit 100 via a PCI (Peripheral Components Interconnect) bus, and reads data to be printed from the image memory 13*b* and outputs the read data to the DRAM control IC 150 in response to instruction signals from the controller control unit 11*b*.

The image memory 13*b* is constituted of a DRAM, and temporarily stores the inputted data to be outputted (data to be printed) therein.

The LANIF 14*b* is a communication interface, such as an NIC (Network Interface Card) or a modem, to connect to the network N such as a LAN, and receives data from the external device PC. The received data is outputted to the DRAM control IC 12*b*.

The body unit 1*a* includes the image reading unit 20, the printing unit 30, an operation display unit 91, and the body control unit 100. The components which are the same as those described above referring to FIG. 1 are denoted by the same alphanumeric references, and the description thereof is omitted.

The body control unit 100 includes the control unit 110, a nonvolatile memory 121, a program memory 122, a RAM (Random Access Memory) 123, a reading processing unit 130, a compression IC 140, the DRAM control IC 150, an image memory 160, an extension IC 170, and a writing processing unit 180.

The control unit 110 includes a CPU (Central Processing Unit), a ROM (Read Only Memory), and a RAM, and performs centralized control of operations of the components of the image forming apparatus 1 in accordance with various processing programs and data stored in the nonvolatile memory 121 and the program memory 122. For example, in response to instruction signals inputted from the operation display unit 91 or the external device PC, the control unit 110 changes modes, a copier mode, a printer mode and a scanner mode, reads the processing programs for their respective modes, and controls copying, printing and reading of image data.

Furthermore, the control unit 110 performs remaining sheet accumulation processing when a jam occurs in the image forming apparatus 1. The remaining sheet accumulation processing is processing to accumulate sheets of paper (remaining sheets) which are being carried in the image forming apparatus 1 when the jam occurs, in one location an accumulation unit S).

The nonvolatile memory 121 stores data processed by the processing programs, such as data for image formation, and the like therein.

For example, the nonvolatile memory 121 stores setting tables T1 and T2 therein. The setting tables T1 and T2 are for setting the number of sheets of paper which can be accumulated in the accumulation unit S (accumulable sheet number) in the remaining sheet accumulation processing, which is performed when a jam occurs.

FIGS. 3 and 4 show the setting tables T1 and T2 as examples.

The setting table T1 is used to set the accumulable sheet number for remaining sheets having a size (the length of a sheet in the paper conveyance direction) of 11 inches or less.

The setting table T2 is used to set the accumulable sheet number for remaining sheets having a size (the length of a sheet in the paper conveyance direction) of more than 11 inches.

In each of the setting tables T1 and T2, the accumulable sheet number is predetermined for plain paper, high-quality paper and coated paper, and different basis weights thereof.

For example, in a case where paper (a remaining sheet) is A4 paper (Size≤11 inches), the high-quality paper, and 105 g, the setting table T1 is referred to, and it is determined that a maximum of seven sheets can be accumulated in the accumulation unit S.

Furthermore, in a case where paper (a remaining sheet) is A3 paper (Size>11 inches), the coated paper, and 136 g, the setting table T2 is referred to, and it is determined that a maximum of two sheets can be accumulated in the accumulation unit S.

A user predetermines the setting tables T1 and T2 to be stored. Furthermore, a user can rewrite the accumulable sheet number predetermined in the setting tables T1 and T2 as needed or desired.

The program memory 122, which is shown in FIG. 2, stores various processing programs for image formation and the like therein.

In the embodiment, the nonvolatile memory 121 and the program memory 122 are individually provided. Alternatively, one nonvolatile memory which stores various processing programs and data may be provided.

The RAM 123 forms a work area where the processing programs executed by the control unit 110 and data for the programs are temporarily stored.

The reading processing unit 130 performs various types of processing, such as analog processing, A/D conversion, and shading, on analog image signals inputted from the image reading unit 20, and generates digital image data. The generated digital image data are outputted to the compression IC 140.

The compression IC 140 compresses the inputted digital image data, and outputs the compressed digital image data the DRAM control IC 150.

The DRAM control IC 150 controls the compression on the digital image data by the compression IC 140 and extension (decompression) on the compressed digital image data by the extension IC 170, and controls input/output of image data into/from the image memory 160, in response to instruction signals from the control unit 110. For example, when the DRAM control IC 150 is instructed to store analog image signals read by the image reading unit 20, the DRAM control IC 150 makes the compression IC 140 compress the digital image data inputted from the reading processing unit 130, and stores the compressed image data into a compression memory 161 of the image memory 160. Furthermore, when the DRAM control IC 150 is instructed to output the compressed image data for printing, the compressed image data being stored in the compression memory 161, the DRAM control IC 150 reads the compressed image data from the compression memory 161, makes the extension IC 170 extend the compressed image data, and stores the extended image data into a page memory 162 of the image memory 160. Furthermore, when the DRAM control IC 150 is instructed to output the extended image data for printing, the extended image data being stored in the page memory 162, the DRAM control IC 150 reads the extended image data from the page memory 162, and outputs the read image data to the writing processing unit 180.

The image memory 160 is constituted of a DRAM, and includes the compression memory 161 and the page memory 162. The compression memory 161 is a memory to store compressed image data. The page memory 162 is a memory to temporarily store image data to be outputted for printing before being outputted.

The extension IC 170 extends (decompresses) inputted compressed image data.

The writing processing unit 180 generates print data for image formation on the basis of the image data inputted from the DRAM control IC 150, and outputs the generated print data to the printing unit 30.

The image reading unit 20 includes the image sensor 21*a*, an image reading control unit 200, and not-shown components of the reading unit 21 which is shown in FIG. 1. The image reading control unit 200 controls the reading unit 21 and the like to make the reading unit 21 and the like scan documents WP placed on a plantain glass (contact glass) by exposing the documents WP to light, and perform photoelectric conversion on reflected light of the light with the image sensor 21*a*, so as to read images on the documents WP as analog image signals. The read image signals are outputted to the reading processing unit 130 of the body control unit 100.

The printing unit 30 includes the image forming unit 40 (image forming units 40Y, 40M, 40C and 40K) shown in FIG. 1, various sensors such as the paper detection sensors 401 and the jam detection sensors 402, other components for printing, and a printing control unit 300.

The printing control unit 30 includes a CPU, a ROM, a RAM, and a nonvolatile memory. In response to instruction signals from the control unit 110, the printing control unit 30 controls operations of the components of the printing unit 30, such as the image forming units 40Y, 40M, 400 and 40K to make the image forming units 40Y, 40M, 40C and 40K form images on paper on the basis of the print data inputted from the writing processing unit 180.

Furthermore, in a case where a jam occurs during image formation, in response to instruction signals from the control unit 110, the printing control unit 300 controls operations of the components, such as the paper feeding unit 70, the carrying unit 80 and the fixing unit 90, to make these units perform the remaining sheet accumulation processing to accumulate sheets of paper (remaining sheets), which are being carried in the image forming apparatus 1 when the jam occurs, in one location in the image forming apparatus 1.

The operation display unit 91 includes an LCD (Liquid Crystal Display) 91*a*, an operation unit 91*b*, and an operation display control unit 900. The operation unit 91*b* includes a touch panel provided to cover the LCD 91*a*, and an operation key set.

The LCD 91*a* displays various setting screens to input various setting conditions, various processing results, and the like thereon, in response to display signals inputted from the control unit 110.

The operation unit 91*b* is used by a user to perform setting inputs to the setting screens displayed on the LCD 91*a*.

The operation display control unit 900 displays the setting screens and the like on the LCD 91*a*, and also outputs operation signals, which correspond to the setting inputs, from the operation unit 91*b*, to the control unit 110, in response to instruction signals inputted from the control unit 110.

The setting screens include a jam processing guide screen (not shown), for example. When a jam occurs, a user can remove the jammed sheet, referring to the jam processing guide screen displayed on the LCD 91*a*.

Here, the remaining sheet accumulation processing is described in detail.

The remaining sheet accumulation processing is performed by the control unit 110 controlling the printing control unit 300. Hence, in the following, the remaining sheet accumulation processing is described, using expressions such as that the control unit 110 does something.

When a jam occurs, the control unit 110 identifies the location where the jam occurs (a jam occurring location) in response to detection signals (a detection result) from the jam detection sensors 402.

If the jam occurring position is in a location other than the resistance unit R, the control unit 110 sets a part of the carrying unit 80, the part including the resistance unit R at least, as the accumulation unit S where remaining sheets are accumulated, in accordance with the sizes of the remaining sheets. The remaining sheets are sheets being carried in the image forming apparatus 1 when the jam occurs, and detected by the paper detection sensors 401. The sizes of the remaining sheets are determined by the paper feeding trays from which the remaining sheets are fed, and to which the sizes thereof are set. Then, the control unit 110 releases, among the resistance roller pair A and the carrying roller pairs B to H, the rollers of each pair located in the accumulation unit S from pressing against each other, and makes the carrying unit 81 carry the remaining sheets to the accumulation unit S.

Figure 5:
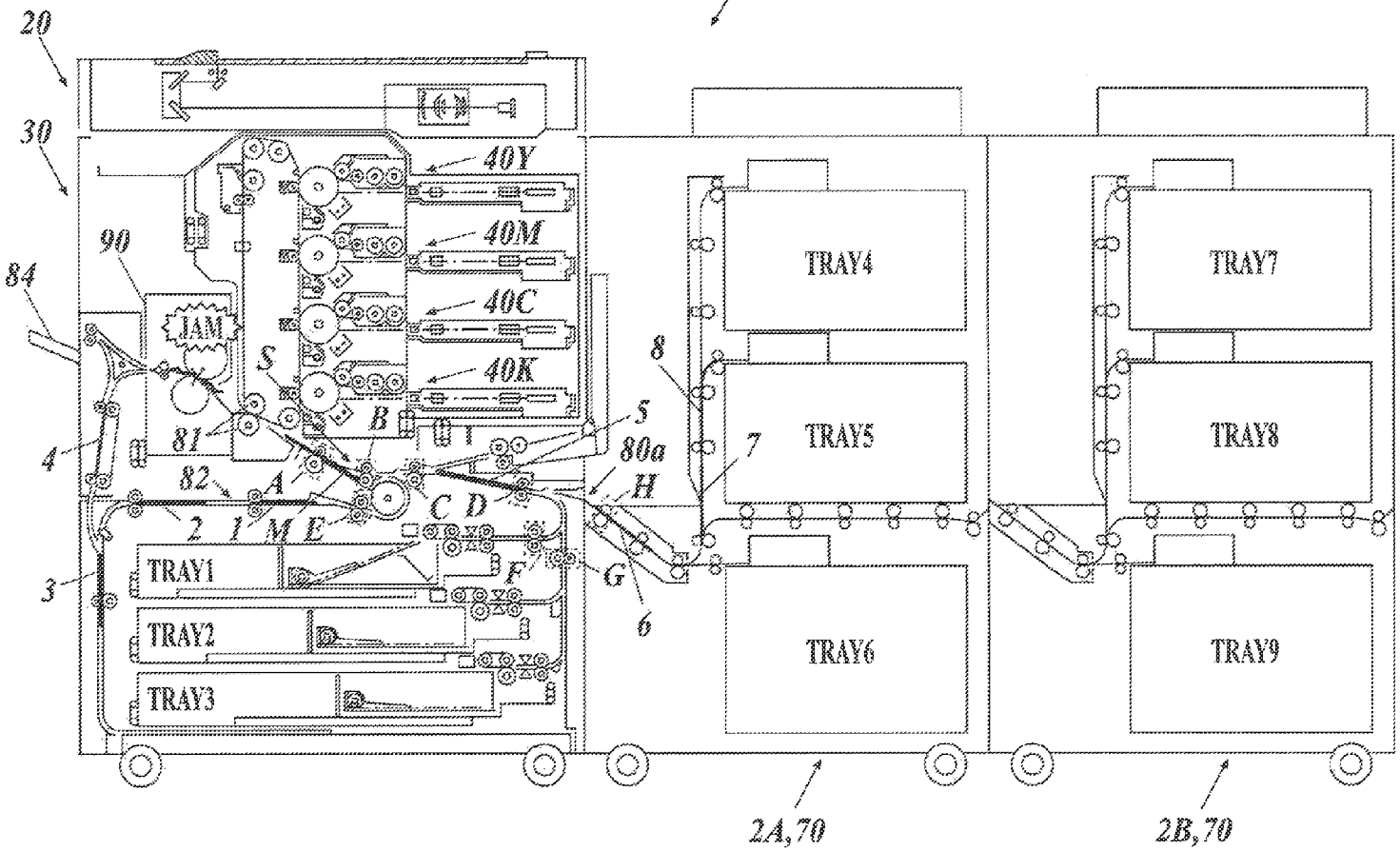
FIG. 5 is a cross-sectional view of the image forming apparatus for explaining remaining sheet accumulation processing.

For example, as shown in FIG. 5, if remaining sheets are A4 paper, the remaining sheets can be accumulated between the resistance roller pair A and the carrying roller pair B. Hence, the control unit 110 sets the location between the resistance roller pair A and the carrying roller pair B as the accumulation unit S, and releases the rollers of the resistance roller pair A from pressing against each other (separates the rollers thereof from each other).

On the other hand, if remaining sheets are larger than A4 paper, the remaining sheets cannot be fitted between the resistance roller pair A and the carrying roller pair B. Hence, the control unit 110 releases the rollers of the resistance roller pair A from pressing against each other, and the rollers of each of the carrying roller pairs B to E and H from pressing against each other.

If remaining sheets are different in size, the control unit 110 decides with respect to each pair whether to separate the rollers from each other or to make the rollers press against each other, in accordance with the maximum size among the sizes of the remaining sheets.

At the time, the control unit 110 decides an order to carry remaining sheets to the accumulation unit S (a carrying order) in accordance with the locations of the remaining sheets, which are detected by the paper detection sensors 401 when the jam occurs.

For example, in a case where remaining sheets exist on the reverse paper path 82, and a jam occurring location does not exist on the reverse paper path 82 nor a paper path from a meeting point of the reverse paper path 82 and the first paper path 80*a* to the accumulation unit S, the control unit 110 makes the carrying unit 80 preferentially carry the remaining sheets on the reverse paper path 82 to the accumulation unit S.

Thus, the carrying order can be decided in such a way that the remaining sheets on the reverse paper path 82 are preferentially carried to the accumulation unit S, because the remaining sheets on the reverse paper path 82 are difficult to be seen and removed. Consequently, if the front door being opened or the like during the remaining sheet accumulation processing stops remaining sheets from being carried to the accumulation unit S, the remaining sheets are left on the reverse paper path 82 as few as possible.

Furthermore, by deciding the carrying order as described above, if remaining sheets exist in two or more locations, for example, on the first paper path 80*a* and the reverse paper path 82, a secondary jam at the meeting point of the locations can be prevented from occurring as the remaining sheets are carried to the accumulation unit S in the decided carrying order.

The carrying order is not limited to the carrying order described above, and hence can be appropriately set in such a way that the remaining sheets in the locations difficult to be removed from are preferentially carried to the accumulation unit S.

Furthermore, the control unit 110 decides the accumulable sheet number in accordance with the kinds of remaining sheets, which are detected by the paper detection sensors 401 when a jam occurs. More specifically, the control unit 110 decides the accumulable sheet number on the basis of the setting tables T1 and T2.

Consequently, the accumulable sheet number suitable for the kinds of remaining sheets can be set. Accordingly, the remaining sheet accumulation processing can be appropriately performed. For example, the accumulable sheet number for thick paper can be set to be less than that for plain paper, so that the remaining sheet accumulation processing can be appropriately performed.

If remaining sheets are different in paper type and/or basis weight, the control unit 110 selects the minimum value among values of the accumulable sheet number of the remaining sheets.

If, according to the setting tables T1 and T2, the accumulable sheet number is one, the control unit 110 does not perform the remaining sheet accumulation processing.

When the number of remaining sheets accumulated in the accumulation unit S (an accumulated sheet number) reaches the accumulable sheet number, the control unit 110 makes the carrying unit stop carrying the remaining sheets to the accumulation unit S. After the remaining sheets accumulated in the accumulation unit S are removed, the control unit 110 makes the carrying unit 80 restart carrying the remaining sheets to the accumulation unit S if remaining sheets which can be carried to the accumulation unit S still exist.

Accordingly, problems, such as that a secondary jam is caused by too many remaining sheets being carried to the accumulation unit S, and that the image forming apparatus 1 is damaged thereby and the like, can be prevented from arising. Furthermore, if the image forming apparatus 1 is large, and a large number of remaining sheets exist therein, by performing accumulation operation of the remaining sheets multiple times, the large number of remaining sheets can be easily removed.

Referring to FIG. 5, an example of the operations of the remaining sheet accumulation processing is described more specifically.

FIG. 5 shows an example of the accumulation operation for nine remaining sheets of paper in the image forming apparatus 1 when a jam occurs at the fixing unit 90 during double-sided printing on A4 paper carried from a tray 5.

In this example, one remaining sheet M exists between the resistance roller pair A and the carrying roller pair B, four remaining sheets 1 to 4 exist on the reverse paper path 82, and four remaining sheets 5 to 8 exist on the first paper path 80*a*.

In this example shown in FIG. 5, the remaining sheets are A4 paper. Hence, the accumulation unit S can be formed between the resistance roller pair A and the carrying roller pair B, and the remaining sheets can be accumulated in the accumulation unit S. The control unit 110 separates the rollers of the resistance roller pair A from each other, and makes the rollers of each of the carrying roller pairs B, C, D, E and H press against each other.

Because, in this case, none of the remaining sheets passes through the carrying roller pair F or G, the control unit 110 separates the rollers of each of the carrying roller pair F and G from each other, which restrains wear of the rollers and electronic currents from motors.

Next, because the remaining sheets are A4 paper, the control unit 110 determines the accumulable sheet number on the basis of the setting table T1. In this example, the remaining sheets are A4 high-quality paper, and the basis weight thereof is 105 g. Hence, the control unit 110 determines from the setting table T1 that a maximum of seven remaining sheets can be accumulated in the accumulation unit S.

Next, the control unit 110 makes the reverse paper path 82 move so that the remaining sheets thereon are carried to the accumulation unit S starting from the remaining sheet 1. At the time, the rollers of the resistance roller pair A are separated from each other. Hence, once the bottom of the remaining sheet 1 is out of the carrying roller pair B, there is no more driving force for the remaining sheet 1, so that the remaining sheet 1 is accumulated on the downstream side of the carrying roller pair B. After the remaining sheets 1 to 4 are carried to the accumulation unit S, the control unit 110 makes the reverse paper path 82 not move.

Next, the control unit 110 makes the first paper path 80*a* move so that the remaining sheets thereon are carried to the accumulation unit S starting from the remaining sheet 5. When the remaining sheet 6 is carried to the accumulation unit S, the remaining sheets accumulated in the accumulation unit S are seven in total as the remaining sheet M exists on the downstream side of the carrying roller pair B (i.e. in the accumulation unit S) from the beginning. Hence, the control unit 110 makes the first paper path 80*a* not move, so as to stop the remaining sheets thereon from being carried.

In this status, a user opens the front door, removes the remaining sheets accumulated in the accumulation unit S, and then closes the front door. Note that the resistance unit R is located to be seen when the front door is open.

Then, the printing control unit 300 under the control of the control unit 110 determines whether or not a jammed sheet exists, and whether or not a remaining sheet exists in the accumulation unit S. The printing control unit 300 also determines whether or not a remaining sheet which can be carried to the accumulation unit S still exists. In this example, the printing control unit 300 determines that no remaining sheet exists in the accumulation unit S because the remaining sheets in the accumulation unit S are removed by a user as described above. The determination whether or not a remaining sheet which can be carried to the accumulation unit S still exists is performed using the paper detection sensors 401 and the jam detection sensors 402.

When determining that a jammed sheet still exists in the fixing unit 90, and a remaining sheet which can be carried to the accumulation unit S (i.e. the remaining sheets 7 and 8) still exists, the control unit 110 separates the rollers of the resistance roller pair A from each other, and makes the rollers of each of the carrying roller pairs B to D (or to E) and H press against each other, for the remaining sheets 7 and 6 which are still in the image forming apparatus 1. Then, the control unit 110 makes the first paper path 80*a* move so that the remaining sheets 7 and 8 are carried to the accumulation unit S. After the remaining sheet 8 is carried to the accumulation unit S, the control unit 110 makes the first paper path 80*a* not move. Thus, after the accumulated remaining sheets in the accumulation unit S are removed, the remaining sheets which are still left in the image forming apparatus 1 (i.e. the rest of the remaining sheets) can be carried to the same accumulation location, namely, the accumulation unit S.

On the other hand, when determining that there is no longer any jammed sheet in the fixing unit 90, and a remaining sheet which can be carried to the accumulation unit S (i.e. the remaining sheets 7 and 8) still exists, the control unit 110 makes the rollers of the resistance roller pair A, and the rollers of each of the carrying roller pairs B to D (or to B) and H press against each other, and makes the first paper path 80*a* move and the fixing unit 90 operate so that the remaining sheets 7 and 8 are carried to the paper ejection tray 84. Thus, the rest of the remaining sheets can be ejected to the paper ejection tray 84.

In the case where remaining sheets are a small size (Size≤11 inches) as described above, two accumulation units may be set by the following operations so that the remaining sheets are removed all together.

First, the control unit 110 separates the rollers of the resistance roller pair A from each other, so that remaining sheets (i.e. the remaining sheets 1 to 6) are carried to the downstream side of the carrying roller pair B so as to be accumulated thereon until the accumulated sheet number reaches the accumulable sheet number. Then, the control unit 110 separates the rollers of each of the carrying roller pairs B and C from each other with the first paper path 80*a* moving, so that the remaining sheets 7 and 8 are accumulated on the downstream side of the carrying roller pair D.

Thus, a user can remove the jammed sheet, the remaining sheets accumulated on the downstream side of the carrying roller pair B and the remaining sheets accumulated on the downstream side of the carrying roller pair D all together with one opening operation of the front door.

As described above, the remaining sheet accumulation processing in the embodiment is performed regardless of whether a jammed sheet still exists or not. That is, even when a jammed sheet is not removed yet, remaining sheets are accumulated in a location from which remaining sheets can be easily removed, if possible.

When using an image forming apparatus which performs mass printing (PP: Production Printing) such as commercial printing, a user moves away from the image forming apparatus to prepare printing paper or the like more frequently than when using an image forming apparatus which performs office printing. Furthermore, even when using the image forming apparatus for office printing, if the image forming apparatus is located far away from a user's desk or the like, the user may come to the image forming apparatus to get outputted paper some time after instructing printing.

In such cases, the image forming apparatus 1 in the embodiment performing the above-described operations allows a user to remove a jammed sheet and accumulated remaining sheets together when the user comes back to the image forming apparatus 1 and notices that a jam occurs, even if the user is away from the image forming apparatus 1 at the time when the jam occurs. Furthermore, after a jammed sheet is removed, the rest of the remaining sheets are ejected from the image forming apparatus 1, which prevents the user from wasting time.

Therefore, for example, as compared with an apparatus which stops its operation completely until a jammed sheet is removed, and finally ejects all remaining sheets in the apparatus therefrom after the jammed sheet is removed and the front door is closed, the image forming apparatus 1 in the embodiment can reduce processing time.

Next, the operations of the remaining sheet accumulation processing in the embodiment are described using a flowchart.

Figure 6:
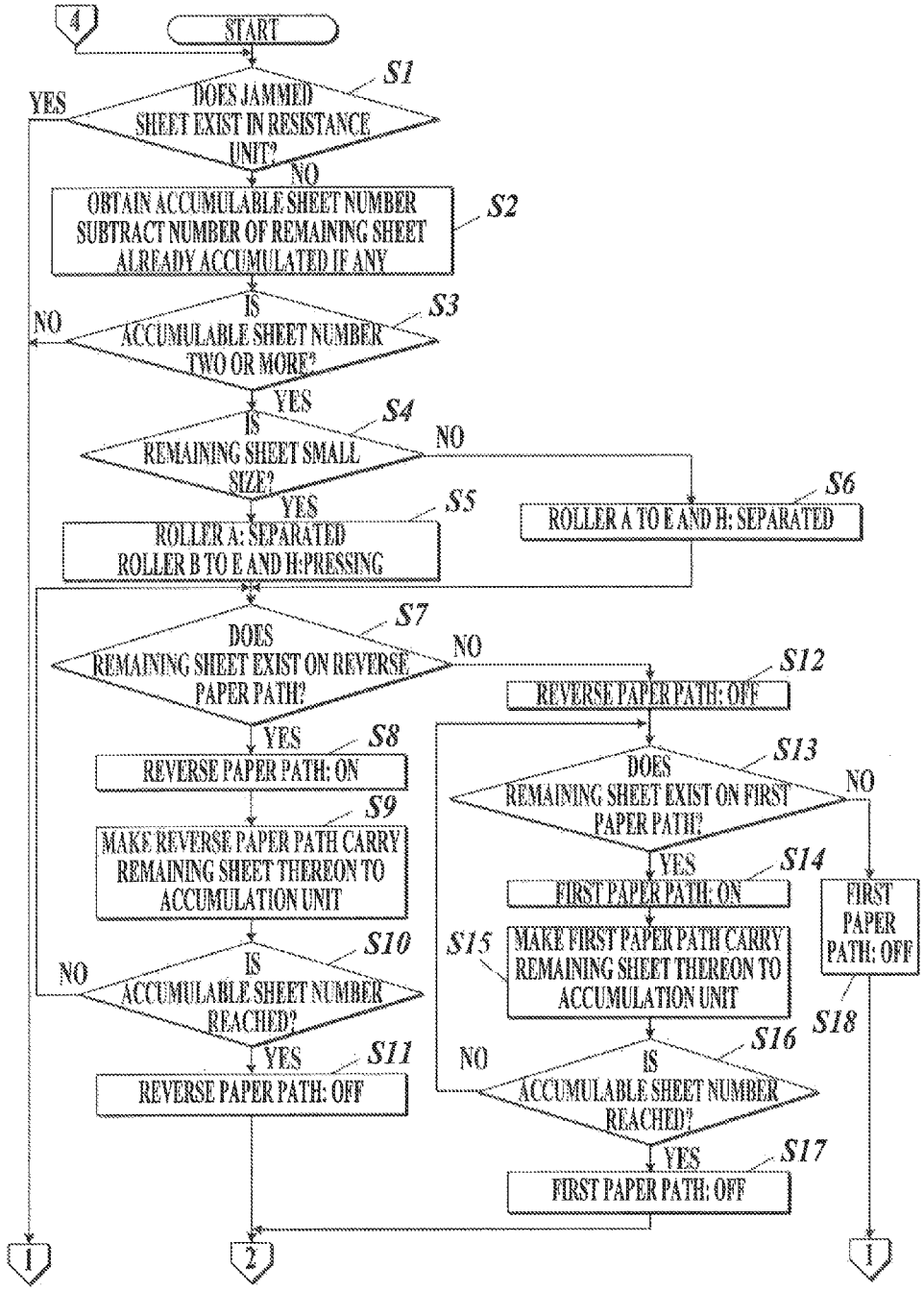
FIG. 6 is a first part of a flowchart of the remaining sheet accumulation processing.
Figure 7:
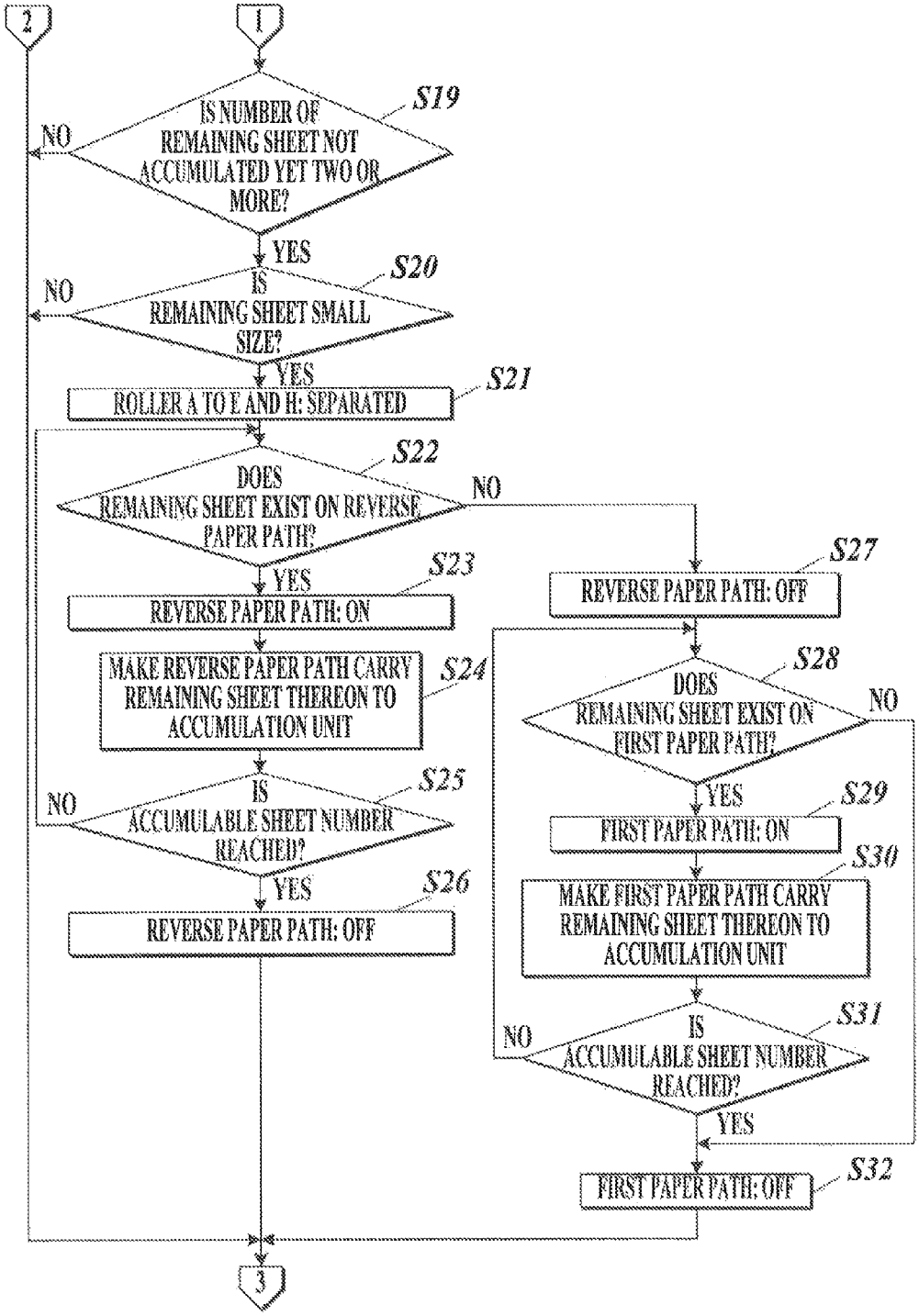
FIG. 7 is a second part of the flowchart of the remaining sheet accumulation processing.
Figure 8:
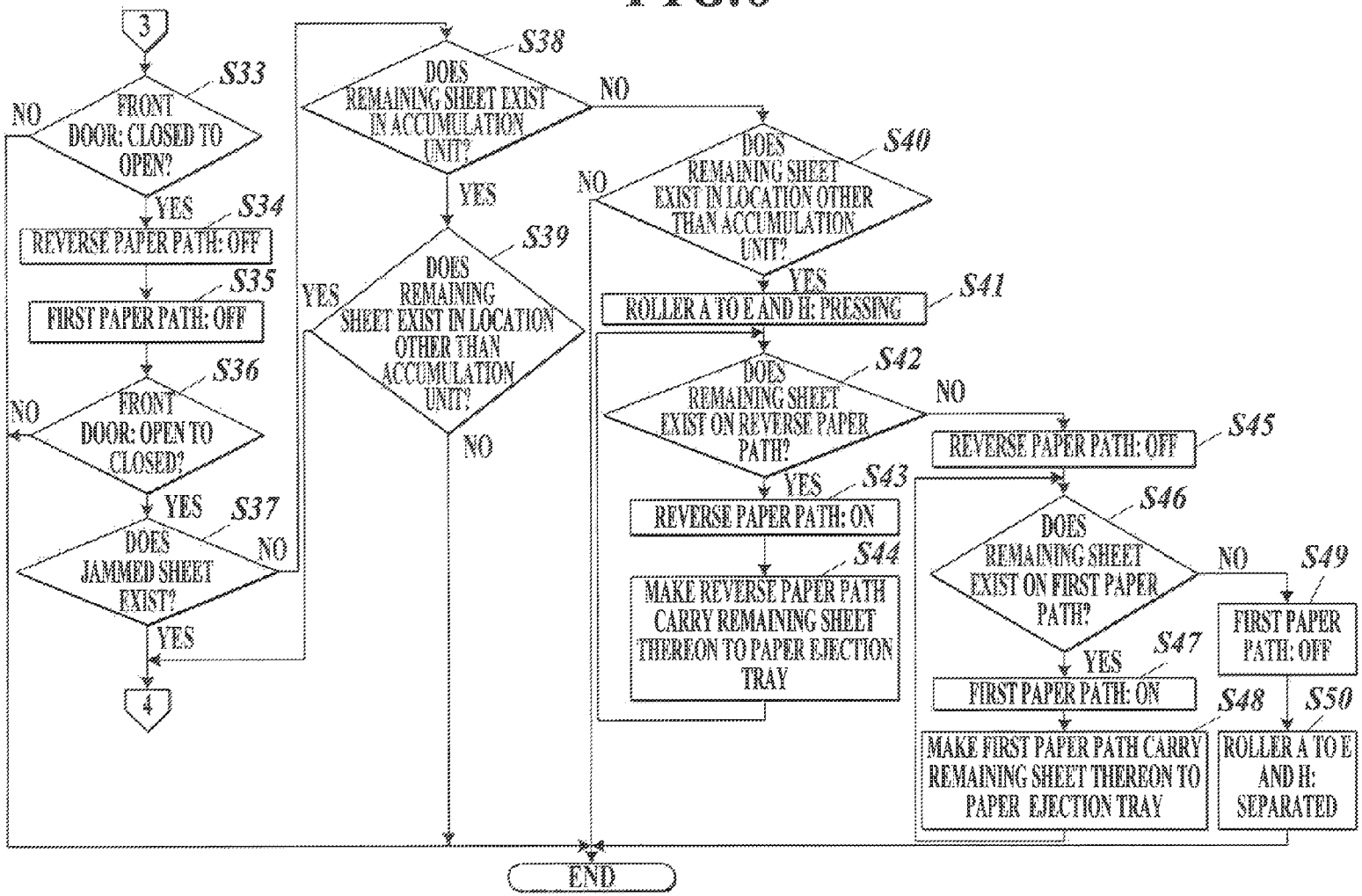
FIG. 8 is a third part of the flowchart of the remaining sheet accumulation processing.

FIGS. 6 to 8 show a flowchart of the remaining sheet accumulation processing, which is performed when a jam occurs, in the embodiment. In the embodiment, the operations shown in FIGS. 6 to 8 are performed by the control unit 110.

The remaining sheet accumulation processing is performed when a jam occurs in the image forming apparatus 1 or the front door of the image forming apparatus 1 is opened.

As shown in FIG. 6, first, the control unit 110 determines whether or not a jammed sheet exists in the resistance unit R (Step S1). When determining that a jammed sheet exists in the resistance unit R (Step S1; YES), the control unit 110 moves to Step S19 described below.

On the other hand, when determining that a jammed sheet does not exist in the resistance unit R (Step S1; NO), the control unit 110 refers to the setting tables T1 and T2 so as to obtain the number of sheets (the accumulable sheet number) which can be accumulated in the resistance unit R in accordance with the size, the paper type, and the basis weight of remaining sheets (Step S2). At this point of time, if some remaining sheets are already in the resistance unit R, the number of the remaining sheets already accumulated therein (the accumulated sheet number) is subtracted from the accumulable sheet number predetermined in the setting table T1 or T2.

Next, the control unit 110 determines whether or not the obtained accumulable sheet number is two or more (step S3). When determining that the obtained accumulable sheet number is not two or more (step S3; NO), the control unit 110 moves to Step S19 described below.

On the other hand, when determining that the obtained accumulable sheet number is two or more (step S3; YES), the control unit 110 determines whether or not the remaining sheets are a small size (i.e. A4 paper or smaller) (Step S4).

When determining that the remaining sheets are a small size (Step S4; YES), the control unit 110 separates the rollers of the resistance roller pair A from each other, and makes the rollers of each of the carrying roller pairs B, C, D, E and H press against each other (Step S5), and then moves to Step S7. Consequently, the location between the resistance roller pair A and the carrying roller pair B is set as the accumulation unit S.

On the other hand, when determining that the remaining sheets are not a small size (Step S4; NO), the control unit 110 separates the rollers of the resistance roller pair A and the rollers of each of the carrying roller pairs B, C, D, E and H from each other (Step S6), and then moves to Step S7. Consequently, the location from the resistance roller pair A to the carrying roller pair H via the carrying roller pairs H, C and D is set as the accumulation unit S.

Next, the control unit 110 determines whether or not a remaining sheet exists on the reverse paper path 82 (Step S7). When determining that a remaining sheet exists on the reverse paper path 82 (Step S7; YES), the control unit 110 makes the reverse paper path 82 more (Step S8), and makes the reverse paper path 82 carry the remaining sheet thereon to the accumulation unit S (Step S9).

Next, the control unit 110 determines whether or not the accumulable sheet number is reached (Step S10) When determining that the accumulable sheet number is not reached (Step S10; NO), the control unit 110 returns to Step S7, and repeats the following steps.

On the other hand, when determining that the accumulable sheet number is reached (Step S10; YES), the control unit 110 makes the reverse paper path 82 not move (Step S11), and moves to Step S33 described below.

At Step S7, when determining that a remaining sheet does not exist on the reverse paper path 82 (Step S7; NO), the control unit 110 makes the reverse paper path 82 not move (Step S12).

Next, the control unit 110 determines whether or not a remaining sheet exists on the first paper path 80*a* (Step S13). When determining that a remaining sheet exists on the first paper path 80*a* (Step S13; YES), the control unit 110 makes the first paper path 80*a* move (Step S14), and makes the first paper path 80*a* carry the remaining sheet thereon to the accumulation unit S (Step S15).

Next, the control unit 110 determines whether or not the accumulable sheet number is reached (Step S16). When determining that the accumulable sheet number is not reached (Step S16; NO), the control unit 110 returns to Step S13, and repeats the following steps.

On the other hand, when determining that the accumulable sheet number is reached (Step S16; YES), the control unit 110 makes the first paper path 80*a* not more (Step S17), and then moves to Step S33 described below.

At Step S13, when determining that a remaining sheet does not exist on the first paper path 80*a* (Step S13; NO), the control unit 110 makes the first paper path 80*a* not move (Step S18), and then moves to Step S19 described below.

As shown in FIG. 7, next, the control unit 110 determines whether or not the number of remaining sheets which are not accumulated yet (a non-accumulated sheet number) is two or more (Step S19). When determining that the non-accumulated sheet number is not two or more (Step S19; NO), the control unit 110 moves to Step S33 described below.

On the other hand, when determining that the non-accumulated sheet number is two or more (Step S19; YES), the control unit 110 determines whether or not the remaining sheets are a small size (A4 paper or smaller) (Step S20). When determining that the remaining sheets are not a small size (A4 paper or smaller) (Step S20; NO), the control unit 110 moves to Step S33 described below.

On the other hand, when determining that the remaining sheets are a small size (Step S20; YES), the control unit 110 separates the rollers of the resistance roller pair A and rollers of each of the carrying roller pairs B, C, D, E and H from each other (Step S21).

Next, the control unit 110 determines whether or not a remaining sheet exists on the reverse paper path 82 (Step S22).

When determining that a remaining sheet exists on the reverse paper path 82 (Step S22; YES), the control unit 110 makes the reverse paper path 82 move (Step S23), makes the reverse paper path 82 carry the remaining sheet thereon to the accumulation unit S (Step S24), and determines whether or not the accumulable sheet number is reached (Step S25). When determining that the accumulable sheet number is not reached (Step S25; NO) the control unit 110 returns to Step S22, and repeats the following steps.

On the other hand, when determining that the accumulable sheet number is reached (Step S25; YES), the control unit 110 makes the reverse paper path 82 not move (Step S26), and then moves to Step S33 described below.

At Step S22, when determining that a remaining sheet does not exist on the reverse paper path 82 (Step S22; NO), the control unit 110 makes the reverse paper path 82 not move (Step S27), and determines whether or not a remaining sheet exists on the first paper path 80*a* (Step S28).

When determining that a remaining sheet does not exist on the first paper path 80*a* (Step S28; NO), the control unit 110 moves to Step S32 described below. On the other hand, when determining that a remaining sheet exists on the first paper path 80*a* (Step S28; YES) the control unit 110 makes the first paper path 80*a* move (Step S29), and makes the first paper path 80*a* carry the remaining sheet thereon to the accumulation unit S (Step S30).

Next, the control unit 110 determines whether or not the accumulable sheet number is reached (Step S31). When determining that the accumulable sheet number is not reached (Step S31; NO), the control unit 110 returns to Step S28, and repeats the following steps.

On the other hand, when determining that the accumulable sheet number is reached (Step S31; YES), the control unit 110 makes the first paper path 80*a* not move (Step S32), and then moves to Step S33 described below.

As shown in FIG. 8, next, the control unit 110 determines whether or not the front door is opened (Step S33). When determining that the front door is not opened (Step S33; NO), the control unit 110 ends the remaining sheet accumulation processing.

On the other hand, when determining that the front door is opened (Step S33; YES), the control unit 110 makes the reverse paper path 82 not move (Step S34), and makes the first paper path 80*a* not more (Step S35).

Next, the control unit 110 determines whether or not the front door is closed (Step S36). When determining that the front door is not closed (Step S36; NO), the control unit 110 ends the remaining sheet accumulation processing.

On the other hand, when determining that the front door is closed (Step S36; YES), the control unit 110 determines whether or not a jammed sheet exists in the image forming apparatus 1 (Step S37). When determining that a jammed sheet exists in the image forming apparatus 1 (Step S37; YES), the control unit 110 returns to Step S1, and repeats the following steps.

On the other hand, when determining that a jammed sheet does not exist in the image forming apparatus 1 (Step S37; NO) the control unit 110 determines whether or not a remaining sheet exists in the accumulation unit S (Step S38).

When determining that a remaining sheet exists in the accumulation unit S (Step S38; YES), the control unit 110 determines whether or not a remaining sheet exists in a location other than the accumulation unit S (Step S39). When determining that a remaining sheet exists in a location other than the accumulation unit S (Step S39; YES), the control unit 110 returns to Step S1, and repeats the following steps. On the other hand, when determining that a remaining sheet does not exist in a location other than the accumulation unit S (Step S39; NO), the control unit 110 ends the remaining sheet accumulation processing.

At Step S38, when determining that a remaining sheet does not exist in the accumulation unit S (Step S38; NO), the control unit 110 determines whether or not a remaining sheet exists in a location other than the accumulation unit S (Step S40). When determining that a remaining sheet does not exist in a location other than the accumulation unit S (Step S40; NO), the control unit 110 ends the remaining sheet accumulation processing.

On the other hand, when determining that a remaining sheet exists in a location other than the accumulation unit S (Step S40; YES), the control unit 110 makes the rollers of the resistance roller pair A and the rollers of each of the carrying roller pairs B, C, D, E and H press against each other (Step S41).

Next, the control unit 110 determines whether or not a remaining sheet exists on the reverse paper path 82 (Step S42). When determining that a remaining sheet exists on the reverse paper path 82 (Step S42; YES), the control unit 110 makes the reverse paper path 82 move (Step S43), makes the reverse paper path 82 carry the remaining sheet thereon to the paper ejection tray 84 (Step S44), and then returns to Step S42 and repeats the following steps.

On the other hand, when determining that a remaining sheet does not exist on the reverse paper path 82 (Step S42; NO) the control unit 110 makes the reverse paper path 82 not move (Step 545).

Next, the control unit 110 determines whether or not a remaining sheet exists on the first paper path 80*a* (Step S46) When determining that a remaining sheet exists on the first paper path 80*a* (Step S46; YES), the control unit 110 makes the first paper path 80*a* move (Step S47), makes the first paper path 80*a* carry the remaining sheet thereon to the paper ejection tray (Step S48), and then returns to Step S46 and repeats the following steps.

On the other hand, when determining that a remaining sheet does not exist on the first paper path 80*a* (Step S46; NO), the control unit 110 makes the first paper path 80*a* not move (Step S49), releases the rollers of the resistance roller pair A and the rollers of each of the carrying roller pairs B, C, B, E and H from pressing against each other (i.e. separates the rollers thereof from each other) (Step S50), and then ends the remaining sheet accumulation processing.

As described above, when a jam occurs in a location other than the resistance unit R according to a detection result of the jam detection sensors 402, the image forming apparatus 1 in the embodiment (i) sets a part of the carrying unit 80, the part including the resistance unit R at least, as the accumulation unit S where remaining sheets are accumulated, in accordance with the size of remaining sheets, which are being carried in the image forming apparatus 1 and detected by the paper detection sensors 401 when the jam occurs, (ii) releases, among the resistance roller pair A and the carrying roller pairs B to H, the rollers of a pair or more which is located in the accumulation unit from pressing against each other, and (iii) makes the carrying unit carry the remaining sheets to the accumulation unit S.

Accordingly, if a plurality of remaining sheets exists in the image forming apparatus 1 when a jam occurs, the remaining sheets can be carried to a location from which remaining sheets can be easily removed, without damaging the image forming apparatus 1.

That is, remaining sheets, which exist in an image forming apparatus when a jam occurs, can be more easily removed from the image forming apparatus 1 without damaging the image forming apparatus 1.

Furthermore, if a jammed sheet is not removed yet, remaining sheets can be accumulated in the accumulation unit S. Accordingly, if the front door of the image forming apparatus 1 is opened a predetermined period of time after a jam occurs, a jammed sheet and accumulated remaining sheets can be removed together, and hence jam processing can be rapidly performed.

Furthermore, the image forming apparatus 1 in the embodiment decides the carrying order of remaining sheets carried to the accumulation unit S in accordance with the locations of the remaining sheets detected by the paper detection sensors 401 when a jam occurs.

Accordingly, the carrying order can be decided in such a way that remaining sheets in locations difficult to be removed from are preferentially carried to the accumulation unit S. Consequently, if the front door being opened during the remaining sheet accumulation processing or the like stops remaining sheets from being carried to the accumulation unit S, the remaining sheets are treated to be removed as easily as possible.

Furthermore, if remaining sheets exist in two or more locations, for example, on the first paper path 80*a* and the reverse paper path 82, a secondary jam at the meeting point of the locations can be prevent from occurring as the remaining sheets are carried to the accumulation unit S in the decided carrying order.

Furthermore, if, according to a detection result of the paper detection sensors 401, a remaining sheet exists on the reverse paper path 82*a*, and according to a detection result of the jam detection sensors 402, a jam occurring location does not exist on a paper path from the meeting point of the reverse paper path 82 and the first paper path 80*a* to the accumulation unit S, the image forming apparatus 1 in the embodiment preferentially carries the remaining sheet on the reverse paper path 82 to the accumulation unit S.

Thus, the carrying order can be decided in such a way that remaining sheets on the reverse paper path 82 difficult to be seen and removed are preferentially carried to the accumulation unit S. Consequently, if the front door being opened during the remaining sheet accumulation processing or the like stops remaining sheets from being carried to the accumulation unit S, the remaining sheets are left on the reverse paper path 82 as few as possible.

Furthermore, the image forming apparatus 1 in the embodiment decides the accumulable sheet number in accordance with the kinds (sizes, paper types, basis weights and the like) of remaining sheets detected by the paper detection sensors 401 when a jam occurs.

Consequently, the accumulable sheet number suitable for the kinds of remaining sheets can be set. Accordingly, the remaining sheet accumulation processing can be appropriately performed.

For example, the accumulable sheet number for thick paper can be set to be less than the accumulable sheet number for plain paper, so that the remaining sheet accumulation processing can be appropriately performed.

Furthermore, the image forming apparatus 1 in the embodiment stops carrying remaining sheets to the accumulation unit S when the number of remaining sheets accumulated in the accumulation unit S, namely, the accumulated sheet number, reaches the accumulable sheet number.

Accordingly, problems such as that, a secondary jam is caused by too many remaining sheets being carried to the accumulation unit S, and that the image forming apparatus 1 is damaged thereby and the like, can be prevented from arising.

Furthermore, the image forming apparatus 1 in the embodiment restarts carrying remaining sheets to the accumulation unit S if, according to detection results of the paper detection sensors 401 and the jam detection sensors 402, remaining sheets which can be carried to the accumulation unit S still exist after remaining sheets accumulated in the accumulation unit S are removed.

Accordingly, if the image forming apparatus 1 is large, and a large number of remaining sheets exist therein, by performing the accumulation operation of remaining sheets multiple times, the large number of remaining sheets can be easily removed.

Furthermore, if the sizes of remaining sheets is smaller than a predetermined size, and, according to a detection result of the paper detection sensors 401, the number of remaining sheets (an existing sheet number) existing in the image forming apparatus is a predetermined number or more, the image forming apparatus 1 in the embodiment (i) sets the accumulation unit S in such a way that the remaining sheets lie within the area of the accumulation unit S; (ii) releases, among the resistance roller pair A and the carrying roller pairs B to H, the rollers of a pair or more which is located in the set accumulation unit S from pressing against each other, (iii) accumulates the predetermined number of the remaining sheets in the set accumulation unit S, (iv) releases, among the carrying roller pairs B to H, the rollers of a pair or more which is located on the upstream side of the set accumulation unit S from pressing against each other, so as to extend the area of the accumulation unit S in such a way that the remaining sheets to be accumulated, namely, the remaining sheets which are not accumulated in the set accumulation unit S, do not overlap with the accumulated remaining sheets, and (v) accumulates the remaining sheets to be accumulated in the extended area of the accumulation unit S.

Accordingly, remaining sheets can be carried to around the resistance unit R so as to be accumulated there as many as possible. Furthermore, a location where remaining sheets are accumulated can be prevented from being changed in accordance with the sizes of remaining sheets. That is, the location includes the resist unit R at least, regardless of the sizes of remaining sheets. Furthermore, if remaining sheets are a small size, and the number of remaining sheets is large, the remaining sheets can be continuously accumulated by changing the accumulation location. Consequently, a large number of remaining sheets can be accumulated by performing the accumulation operation one time.

In the embodiment, the accumulable sheet number is decided in accordance with the kinds of remaining sheets, namely, the sizes, the paper types, and the basis weights of remaining sheets, using the setting table T1 and T2. However, the accumulable sheet number may be decided in accordance with at least one of the sizes, the paper types, and the basis weights of remaining sheets.

That is, the present invention may be configured to have, instead of the setting tables T1 and T2, a table in which the accumulable sheet number is predetermined for each size of remaining sheets, a table in which the accumulable sheet number is predetermined for each basis weight of remaining sheets, and/or a table in which the accumulable sheet number is determined for each paper type of remaining sheets, and to decide the accumulable sheet number using these tables.

Furthermore, in the embodiment, the image forming apparatus 1 includes the intermediate transfer belt 61 as the image holder. However, the present invention may be configured in such a way that the photosensitive drum 41 is used as the image holder, and the toner images formed on the photosensitive drum 41 are transferred to paper without the image transfer belt 61.

According to an aspect of the preferred embodiment, there is provided an image forming apparatus including a paper feeding unit which sends out a sheet of paper from a paper feeding tray where the sheet is housed; a transfer unit which transfers a toner image formed on an image holder to the sheet sent out by the paper feeding unit; a carrying unit including a first paper path provided with a plurality of carrying roller pairs each of which is a pair of rollers capable of pressing against each other and being separated from each other, the carrying unit which carries the sheet sent out by the paper feeding unit to the transfer unit with the first paper path; a resistance unit disposed in the carrying unit, and including a resistance roller pair which is a pair of rollers capable of pressing against each other and being separated from each other, the resistance unit which carries the sheet to the transfer unit after stopping the sheet on an upstream side of the transfer unit; a jam detection unit which detects a jam occurring location where a jam occurs; a paper detection unit which detects a sheet location of the sheet being carried; and a control unit which, in response to the jam detection unit detecting that the jam occurring location is outside the resistance unit, (i) sets, in accordance with a size of a remaining sheet which is being carried and is detected by the paper detection unit when the jam occurs, a part of the carrying unit as an accumulation unit where the remaining sheet is accumulated, the part including at least the resistance unit, (ii) releases, among the resistance roller pair and the carrying roller pairs, the rollers of a pair located in the accumulation unit from pressing against each other, and (iii) makes the carrying unit carry the remaining sheet to the accumulation unit.

Preferably, in the image forming apparatus, the control unit decides a carrying order of the remaining sheet to the accumulation unit in accordance with the sheet location of the remaining sheet detected by the paper detection unit when the jam occurs.

Preferably, in the image forming apparatus, the carrying unit further includes a second paper path which reverses the sheet, to one side of which the toner image is transferred by the transfer unit, and carries the sheet to the first paper path, and in response to the paper detection unit detecting that the remaining sheet exists on the second paper path, and the jam detection unit detecting that the jam occurring location does not exist on a paper path from a meeting point of the first paper path and the second paper path to the accumulation unit, the control unit makes the carrying unit preferentially carry the remaining sheet on the second paper path to the accumulation unit.

Preferably, in the image forming apparatus, the control unit decides an accumulable sheet number of the remaining sheet accumulable in the accumulation unit in accordance with a kind of the remaining sheet detected by the paper detection unit when the jam occurs.

Preferably, in the image forming apparatus, the control unit decides the accumulable sheet number in accordance with at least one of a size, a paper type and a basis weight of the remaining sheet as the kind of the remaining sheet.

Preferably, in the image forming apparatus, when an accumulated sheet number of the remaining sheet accumulated in the accumulation unit reaches the accumulable sheet number, the control unit makes the carrying unit stop carrying the remaining sheet to the accumulation unit.

Preferably, in the image forming apparatus, in response to the paper detection unit detecting that the remaining sheet capable of being carried to the accumulation unit still exists after the accumulated remaining sheet in the accumulation unit is removed, the control unit makes the carrying unit restart carrying the remaining sheet to the accumulation unit.

Preferably, in the image forming apparatus, in response to a size of the remaining sheet being smaller than a predetermined size, and an existing sheet number of the remaining sheet existing in the image forming apparatus being a predetermined number or more, the control unit (i) sets the accumulation unit in such a way that the remaining sheet lies within the accumulation unit, (ii) releases the rollers of the pair located in the set accumulation unit from pressing against each other, (iii) accumulates the predetermined number of the remaining sheet in the set accumulation unit, (iv) releases, among the carrying roller pairs, the rollers of a pair located on an upstream side of the set accumulation unit, so as to extend the set accumulation unit in such a way that the remaining sheet to be accumulated does not overlap with the accumulated remaining sheet, and (v) accumulates the remaining sheet to be accumulated in the extended accumulation unit.

This application is based upon and claims the benefit of priority under 35 USC 119 of Japanese Patent Application No, 2011-228779 filed on Oct. 18, 2011, the entire disclosure of which, including the description, claims, drawings, and abstract, is incorporated herein by reference in its entirety.

What is claimed is:

1. An image forming apparatus comprising:

a paper feeding unit which sends out a sheet of paper from a paper feeding tray where the sheet is housed;

a transfer unit which transfers a toner image formed on an image holder to the sheet sent out by the paper feeding unit;

a carrying unit including a first paper path provided with a plurality of carrying roller pairs each of which is a pair of rollers capable of pressing against each other and being separated from each other, the carrying unit which carries the sheet sent out by the paper feeding unit to the transfer unit with the first paper path;

a resistance unit disposed in the carrying unit, and including a resistance roller pair which is a pair of rollers capable of pressing against each other and being separated from each other, the resistance unit which carries the sheet to the transfer unit after stopping the sheet on an upstream side of the transfer unit;

a jam detection unit which detects a jam occurring location where a jam occurs;

a paper detection unit which detects a sheet location of the sheet being carried; and a control unit which, in response to the jam detection unit detecting that the jam occurring location is outside the resistance unit, (i) sets, in accordance with a size of a remaining sheet which is being carried and is detected by the paper detection unit when the jam occurs, a part of the carrying unit as an accumulation unit where the remaining sheet is accumulated, the part including at least the resistance unit, (ii) releases, among the resistance roller pair and the carrying roller pairs, the rollers of a pair located in the accumulation unit from pressing against each other, and (iii) makes the carrying unit carry the remaining sheet to the accumulation unit.

2. The image forming apparatus according to claim 1, wherein the control unit decides a carrying order of the remaining sheet to the accumulation unit in accordance with the sheet location of the remaining sheet detected by the paper detection unit when the jam occurs.

3. The image forming apparatus according to claim 2, wherein the carrying unit further includes a second paper path which reverses the sheet, to one side of which the toner image is transferred by the transfer unit, and carries the sheet to the first paper path, and in response to the paper detection unit detecting that the remaining sheet exists on the second paper path, and the jam detection unit detecting that the jam occurring location does not exist on a paper path from a meeting point of the first paper path and the second paper path to the accumulation unit, the control unit makes the carrying unit preferentially carry the remaining sheet on the second paper path to the accumulation unit.

4. The image forming apparatus according to claim 1, wherein the control unit decides an accumulable sheet number of the remaining sheet accumulable in the accumulation unit in accordance with a kind of the remaining sheet detected by the paper detection unit when the jam occurs.

5. The image forming apparatus according to claim 4, wherein the control unit decides the accumulable sheet number in accordance with at least one of a size, a paper type and a basis weight of the remaining sheet as the kind, of the remaining sheet.

6. The image forming apparatus according to claim 4, wherein when an accumulated sheet number of the remaining sheet accumulated in the accumulation unit reaches the accumulable sheet number, the control unit makes the carrying unit stop carrying the remaining sheet to the accumulation unit.

7. The image forming apparatus according to claim 6, wherein in response to the paper detection unit detecting that the remaining sheet capable of being carried to the accumulation unit still exists after the accumulated remaining sheet in the accumulation unit, is removed, the control unit makes the carrying unit restart carrying the remaining sheet to the accumulation unit.

8. The image forming apparatus according to claim 1, wherein in response to a size of the remaining sheet being smaller than a predetermined size, and an existing sheet number of the remaining sheet existing in the image forming apparatus being a predetermined number or more, the control unit (i) sets the accumulation unit in such a way that the remaining sheet lies within the accumulation unit, (ii) releases the rollers of the pair located in the set accumulation unit from pressing against each other, (iii) accumulates the predetermined number of the remaining sheet in the set accumulation unit, (iv) releases, among the carrying roller pairs, the rollers of a pair located on an upstream side of the set accumulation unit, so as to extend the set accumulation unit in such a way that the remaining sheet to be accumulated does not overlap with the accumulated remaining sheet, and (v) accumulates the remaining sheet to be accumulated in the extended accumulation unit.

* * * * *